US005795171A

United States Patent [19]

Bernardini

[11] Patent Number: 5,795,171

[45] Date of Patent: Aug. 18, 1998

[54] ALL PLASTIC ZERO INSERTION FORCE ELECTRICAL CONNECTOR

[75] Inventor: Allen J. Bernardini, Southbury, Conn.

[73] Assignee: Litton Systems, Inc., Watertown, Conn.

[21] Appl. No.: 683,065

[22] Filed: Jul. 16, 1996

[51] Int. Cl.[6] ..... H01R 13/15

[52] U.S. Cl. ..... 439/260; 439/931

[58] Field of Search ..... 439/260, 263, 439/267, 635, 637, 725, 864, 931

[56] References Cited

U.S. PATENT DOCUMENTS

| | | | |
|---|---|---|---|
| 3,605,075 | 9/1971 | Stofkooper | 439/931 |
| 3,614,707 | 10/1971 | Kaufmann et al. | 439/260 |
| 3,639,888 | 2/1972 | Pittman et al. | 439/260 |
| 3,980,375 | 9/1976 | Rosen | 439/260 |
| 4,148,537 | 4/1979 | Sochor | 439/267 |
| 4,322,120 | 3/1982 | Rilling | 439/631 |
| 4,533,189 | 8/1985 | Scoccia et al. | 439/260 |
| 4,581,495 | 4/1986 | Geri et al. | 439/493 |
| 4,626,056 | 12/1986 | Andrews, Jr. | 439/260 |
| 4,629,270 | 12/1986 | Andrews, Jr. | 439/260 |
| 4,780,087 | 10/1988 | Berg et al. | 439/630 |
| 4,904,197 | 2/1990 | Cabourne | 439/260 |
| 4,977,668 | 12/1990 | McKenzie, Jr. | 439/931 |
| 5,088,009 | 2/1992 | Harada et al. | 439/931 |
| 5,132,877 | 7/1992 | Branan et al. | 439/931 |
| 5,145,381 | 9/1992 | Volz | 439/260 |
| 5,158,470 | 10/1992 | Zarreii | 439/620 |
| 5,173,058 | 12/1992 | Broeksteeg et al. | 439/267 |
| 5,387,131 | 2/1995 | Foreman et al. | 439/620 |
| 5,427,533 | 6/1995 | Chambers | 439/493 |

FOREIGN PATENT DOCUMENTS

| | | | |
|---|---|---|---|
| A1 272 008 | 11/1987 | European Pat. Off. | H01R 23/68 |
| 0078171 | 3/1990 | Japan | H01R 23/68 |

OTHER PUBLICATIONS

IBM Technical Disclosure Bulletin, Male Card Edge-to-Ribbon Cable Connector, Vol. 33, No. 8, pp. 435–436, Jan. 1991.

*Primary Examiner*—Gary F. Paumen
*Assistant Examiner*—Brian J. Biggi
*Attorney, Agent, or Firm*—Michael H. Wallach; Gerald L. Lett; Scott J. Coonan

[57] ABSTRACT

A all-plastic ZIF (zero insertion force) electrical connector offers the advantages of low cost and ease of manufacturing inherent to plastic. According to a first embodiment of the invention, an all-plastic ZIF electrical connector has a bias means connected to a first half of the connector for providing a bias force to force the first half of the connector against a PCB (printed circuit board) or other circuitry inserted between the first half and a second half of the connector. According to a second embodiment of the present invention, the all-plastic ZIF electrical connector is attached to a flexible printed circuit which allows a first half of the ZIF electrical connector to be flexed slightly to increase the space between the contact fingers to accommodate insertion of the PCB without the need to force the PCB between the contact-making fingers of the connector when the PCB is inserted into the connector. In particular the connector is intended to be used on a flexible printed circuit which can be flexed slightly to increase the space between the contact fingers to accommodate insertion of the PCB. After the PCB has been inserted into the space between the electrical contact fingers, fastening means may be attached onto the ends of the electrical connector to maintain the electrical contact between the electrical connector and the PCB. The second embodiment offers the ability to insert the PCB with low or no insertion force, thus avoiding damage to electrical contacts on the PCB while still being able to effect a tight mechanical and electrical contact between the contacts of the connector and the connections on the PCB.

13 Claims, 2 Drawing Sheets

ALL PLASTIC ZERO INSERTION FORCE ELECTRICAL CONNECTOR

BACKGROUND OF THE INVENTION

The present invention relates generally to electrical connectors and more specifically to all-plastic ZIF (zero insertion force) electrical connectors.

In many industries, such as the telecommunications and computer industries, ZIF (zero insertion force) electrical connectors enjoy wide popularity as a means to connect a daughter card to a mother board. A daughter card may be inserted into the ZIF electrical connector with little or no insertion force required, thus avoiding damage to electrical contacts on the daughter card while still being able to effect a tight mechanical and electrical contact between the contacts of the connector and the connections on the daughter card.

ZIF electrical connectors currently available, however, while avoiding damage to daughter card electrical contacts do not provide for the daughter card to be easily and readily inserted and removed as desired. U.S. Pat. No. 3,614,707 issued to Kaufmann et al. on Oct. 19, 1971, for instance, provides means for protecting the electrical contacts of a PCB while inserting or removing the PCB from an electrical connector but requires the physical removal of a spring member prior to removing the PCB from the electrical connector. Thus, there is an unmet need in the art to allow for the safe and easy insertion and removal of a PCB from an electrical connector without the need for disassembling a portion of the electrical connector in order to effectuate the PCB removal.

In addition to the use of spring members in the prior art to secure a PCB in a zero insertion force connector, the use of cam means have also been used to secure the insertion of a PCB in an electrical connector. A number of United Stated Patents, including U.S. Pat. No. 4,904,197 issued to Cabourne on Feb. 27, 1990 ('197 patent), U.S. Pat. No. 4,629,270 issued to Andrews Jr., et al. on Dec. 16, 1986 ('270 patent), and U.S. Pat. No. 4,626,056 issued to Andrews Jr., et al. on Dec. 2, 1986, discuss the use of cams in conjunction with ZIF electrical connectors ('056 patent). In U.S. Pat. No. 4,904,197, a cam in conjunction with a spring controls simultaneous movement of a first and a second frame portion of the housing of the ZIF electrical connector away from or towards each other in order to effectuate insertion and removal of a card from the ZIF electrical connector. The '270 and '056 patents likewise disclose that cams that ensure that two halves of the housing of the electrical connector simultaneously move together or apart when removing or inserting a card in the electrical connector. The requirement that multiple parts of the ZIF electrical connector, as opposed to one part of the electrical connector, must simultaneously move in order to accommodate insertion and removal of a card increases the likelihood that the connector will not operate as required.

In addition to requiring multiple parts of the electrical connector to move in order to accommodate a PCB, the cam of the prior art ZIF electrical connector often must operate in conjunction with other parts of the connector and is not sufficient in itself. Referring to the '197 patent, the cam must operate in conjunction with a spring in order to insert or remove a card from the ZIF electrical connector. The '056 patent discloses that cams operate in conjunction with cam followers to control simultaneous movement of two halves of the connector housing. The '056 patent further requires the use of an external tool such as a screwdriver to activate the cam. There is thus an unmet need in the art to be able to accommodate insertion and removal of a PCB in a ZIF electrical connector having a cam with a minimum of moving parts of the electrical connector, without the need for external tools to activate cam means, and without the requirement that parts of both halves of the electrical connector move.

In addition to the foregoing problems associated with existing ZIF electrical connectors, there is further a need to make use of the advantages to be afforded by plastic in ZIF electrical connectors. Electronic connector art today allows for discrete contacts to be housed in a plastic insulator such that they can be attached to wires or a PC board by many means, such as by crimp, solder, press-fit, surface mount and compression. Known plastic molding and electroplating techniques allow the capability to apply selective plating of conductive metals onto plastics. In this way, all-plastic connectors are capable of being produced today.

The use of plastics in electrical connectors offers several important advantages. Plastic is a low cost medium that reduces the cost of an item being manufactured in plastic. Additionally, manufacture of a plastic item offers ease of manufacturing in large quantity, especially when the object being manufactured is all plastic. The advantages to be gained from the use of plastics have not been fully developed with respect to ZIF electrical connectors. The prior art does not offer nor contemplate a ZIF electrical connector that makes maximum use of the advantages to be afforded by the plastic medium. There is thus an unmet need in the art to more fully maximize the benefits of plastic with respect to ZIF electrical connectors.

SUMMARY AND OBJECTS OF THE INVENTION

It would be advantageous in the art to allow a PCB to be readily and easily inserted and removed from a ZIF electrical connector without the need for special tools or the removal of parts of the electrical connector.

It would further be advantageous in the art to be able to accommodate insertion and removal of a PCB in a ZIF electrical connector having a cam with a minimum of moving parts of the electrical connector, without the need for external tools to activate the cam, and without the requirement that parts of both halves of the electrical connector move.

It would be advantageous in the art to have a zero insertion force electrical connector which utilizes the benefits inherent in plastic as described above.

Therefore, according to the present invention, an all-plastic ZIF (zero insertion force) electrical connector is disclosed. The all-plastic ZIF electrical connector offers the advantages of low cost and ease of manufacturing inherent to plastic and also allows for a PCB to be safely and readily inserted and removed from the all-plastic ZIF electrical connector without the need for special tools or removal of parts of the all-plastic ZIF electrical connector.

According to a first embodiment of the invention, an all-plastic ZIF electrical connector has a bias means connected to a first half of the connector for providing a bias force to force the first half of the connector against a PCB (printed circuit board) or other circuitry inserted between the first half and a second half of the connector in order to secure the PCB between the first half and the second half of the connector and in order to establish electrical contact between the connector and the PCB.

According to a second embodiment of the present invention, the all-plastic ZIF electrical connector is attached to a flexible means, such as a flexible printed circuit, which is capable of being slightly flexed in order to increase the space between the contact fingers thereby easily and safely accommodating insertion and removal of the PCB into an electrical connector without the possibility of damaging electrical contacts of the PCB by forcing the PCB between the contact-making fingers of the electrical connector and without the need for removing a portion of the electrical connector prior to removing the PCB from the electrical connector. In particular, the connector is intended to be used on a flexible printed circuit which can be flexed slightly to increase the space between the contact fingers to accommodate insertion of the PCB. After the PCB has been located into the space between the electrical contact fingers, fastening means may be optionally attached onto the ends of the electrical connector to force the contact fingers against the mating electrical contacts on the PCB. The second embodiment offers the ability to insert the PCB with low or no insertion force, thus avoiding damage to electrical contacts on the PCB while still being able to effect a tight mechanical and electrical contact between the contacts of the connector and the connections on the PCB.

It is accordingly an object of the invention to have a zero insertion force electrical connector which utilizes the benefits inherent in plastic.

This and other objects of the invention will become apparent from the detailed description of the invention in which numerals used through the description correspond to those found in the drawing figures.

BRIEF DESCRIPTION OF THE DRAWINGS

The novel features believed characteristic of the invention are set forth in the appended claims. The invention itself, however, as well as a preferred mode of use, and further objects and advantages thereof, will best be understood by reference to the following detailed description of an illustrative embodiment when read in conjunction with the accompanying drawings, wherein:

DESCRIPTION OF THE INVENTION

ZIF (zero insertion force) electrical connectors are commonly used in many industries, such as the telecommunications and computer industries, as a means of connecting a PCB (printed circuit board) such as a daughter card to a mother board. A PCB is inserted into the ZIF electrical connector with little or no insertion force required, thus avoiding damage to electrical contacts on the PCB while still being able to effect a tight mechanical and electrical contact between the contacts of the connector and the connections on the PCB. The ZIF electrical connector of the present invention is manufactured of plastic, by molding for example, and thus inherently possesses the advantages offered by the plastic medium, such as low cost, ease of manufacturing, and electrical insulating characteristics. The ZIF electrical connector of the present invention accommodates insertion and removal of a PCB with a minimum of moving parts since only one half of the housing of the electrical connector need move in order to effectuate safe insertion or removal of the PCB.

Figure 1B:
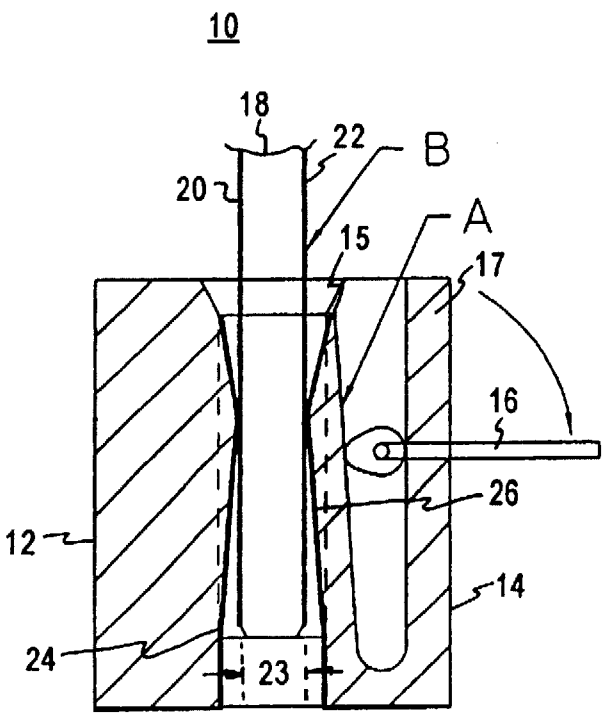
FIG. 1*b* is a side view of an all-plastic zero insertion force electrical connector after a bias force is applied, according to a first embodiment of the present invention.
Figure 1A:
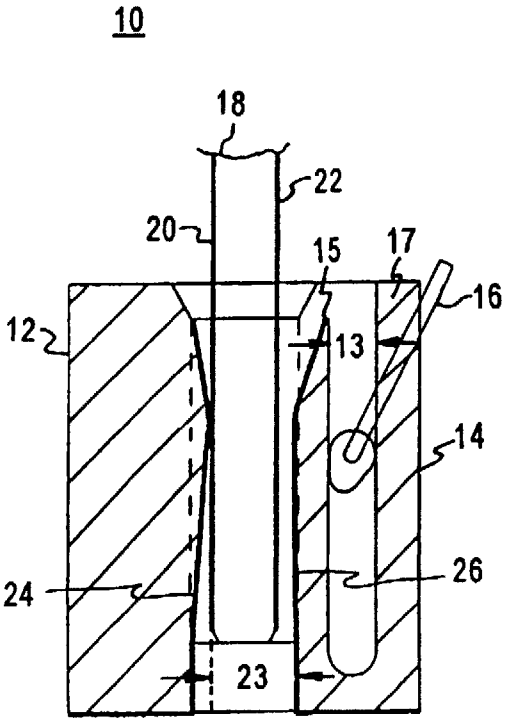
FIG. 1*a* is a side view of an all-plastic zero insertion force electrical connector before a bias force is applied, according to a first embodiment of the present invention.

Referring to FIG. 1*a*, a side view of an all-plastic zero insertion force electrical connector 10 before a bias force is applied according to a first embodiment of the present invention, is shown. ZIF electrical connector 10 is made of all-plastic and is comprised of two halves: a first half 12 and a second half 14. The second half 14 of the ZIF electrical connector 10 is further comprised of a contact finger portion 15 and a fixed portion 17. Connected along a longitudinal axis of second half 14 in the cavity 13 formed between contact finger portion 15 and fixed portion 17 is a bias means 16. Bias means 16 when activated by finger action as shown in FIG. 1*b* rotates along its longitudinal axis and exerts a bias force on an inserted PCB to retain it in place and to effect an electrical contact between contacts on the connector 10 and the PCB. Bias means 16 may be a cam, a lever, a wedge, a knob which when rotated about its longitudinal axis away from the ZIF electrical connector 10 exerts a bias force to force the second half of the electrical connector 14 against one or more contact traces 22 on the PCB as shown in FIG. 1*b*. The connector halves 12 and 14 are installed on a PCB or other rigid circuitry and are hinged along their longitudinal axes.

Referring again to FIG. 1*a*, before bias means 16 is rotated about its longitudinal axis to exert a bias force, a PCB 18 is loosely inserted in cavity 13 between first half 12 and second half 14. Contact trace 20 of PCB 18 loosely rests against first half 12 resulting in a zero contact force between contact trace 20 and conductive trace 24 of first half 12. As shown in FIG. 1*a*, no such contact need exist between contact trace 22, on the opposite side of PCB 18, and conductive trace 26 of second half 14 of ZIF electrical connector 10. Of course, one skilled in the art will recognize that depending upon the angle at which PCB 18 is inserted, contact trace 22 may make a zero contact force with conductive trace 26 of second half 14. Conductive trace 24 is a conductive trace that may be screened or plated onto first half 12 and conductive trace 26 of contact finger 15 is a conductive trace that may be screened or plated onto the contact finger 15.

Referring to FIG. 1*b*, a side view of all-plastic zero insertion force electrical connector 10 after a bias force is applied through bias means 16, according to the first embodiment of the present invention, is shown. Once PCB 18 is inserted into the opening 23 between first half 12 and second half 14, bias means 16 may be rotated about its longitudinal axis to exert a bias force in order to retain PCB 18 between first half 12 and second half 14. As shown in FIG. 1*b*, bias means 16 is rotated clockwise about its longitudinal axis to force contact finger portion 15 of second half 14 against contact trace 22 of PCB 18; this is shown as forcing "A" towards "B" in FIG. 1*b*. Note that activation of bias means 16 through this clockwise rotation has the effect of moving contact finger portion 15 until conductive trace 26 of contact finger portion 15 makes electrical contact with contact trace 22 of PCB 18; fixed portion 17 of second half 14 remains fixed and does not move upon activation of bias means 16. Once bias means 16 is thus activated through clockwise rotation, a high contact force is established between first half 12 and contact trace 20 and between the contact finger portion 15 of second half 14 and contact trace 22 as shown. The bias means 16, then, provides a mechanism to maintain the desired electrical connection between the contact traces 20 and 22 of the PCB 18 and conductive traces 24 and 26 of the first half and the second half, respectively, of ZIF electrical connector 10.

The bias force means of the first embodiment of the present invention offers a simple yet effective design that offers significant benefits over the prior art. Unlike U.S. Pat. No. 4,904,197 which disclosed the use of a cam in conjunction with a spring, cam 16 of the present invention need not be used in conjunction with other means to secure the PCB 18 inside ZIF electrical connector 10. The present invention is likewise distinguished over U.S. Pat. No. 4,626,056 which discloses cams which operate in conjunction with cam followers to control simultaneous movement of two halves of the connector housing.

Additionally, the first embodiment of the present invention only requires that one half of the housing of the ZIF electrical connector need move, under control of the cam bias means, in order to secure a PCB in the ZIF electrical connector. This advantage is not to be found in the prior art where both halves of the electrical connector must simultaneously move to secure the PCB in the electrical connector. In U.S. Pat. No. 4,904,197, a cam in conjunction with a spring controls simultaneous movement of a first and a second frame portion of the housing of the ZIF electrical connector away from or towards each other in order to effectuate insertion and removal of a card from the ZIF electrical connector. U.S. Pat. Nos. 4,629,270 and 4,626,056 likewise disclose that cams ensure that two halves of the housing of the electrical connector simultaneously move together or apart when removing or inserting a card in the electrical connector. The requirement that multiple parts of the ZIF electrical connector, as opposed to one part of the electrical connector, must simultaneously move in order to accommodate insertion and removal of a card increases the likelihood that the connector will not operate as required. It is also important to note that the first embodiment of the present invention does not require special tools in order to activate the bias means represented by cam 16. Simple finger action is all that is required to activate cam 16. This is in marked contrast to some prior art cam means that require special tools to activate. For instance, U.S. Pat. No. 4,626,056 discloses the use of a special tool such as a screwdriver to activate the cam.

Figure 2B:
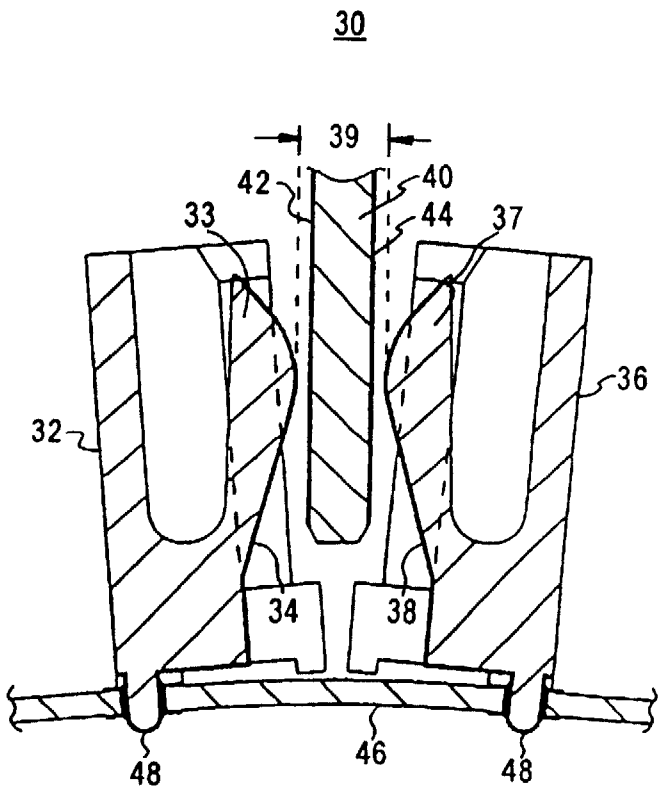
FIGS. 2*a* and 2*b* show side views of an all-plastic zero insertion force electrical connector mounted on flex circuitry, according to a second embodiment of the present invention.
Figure 2A:
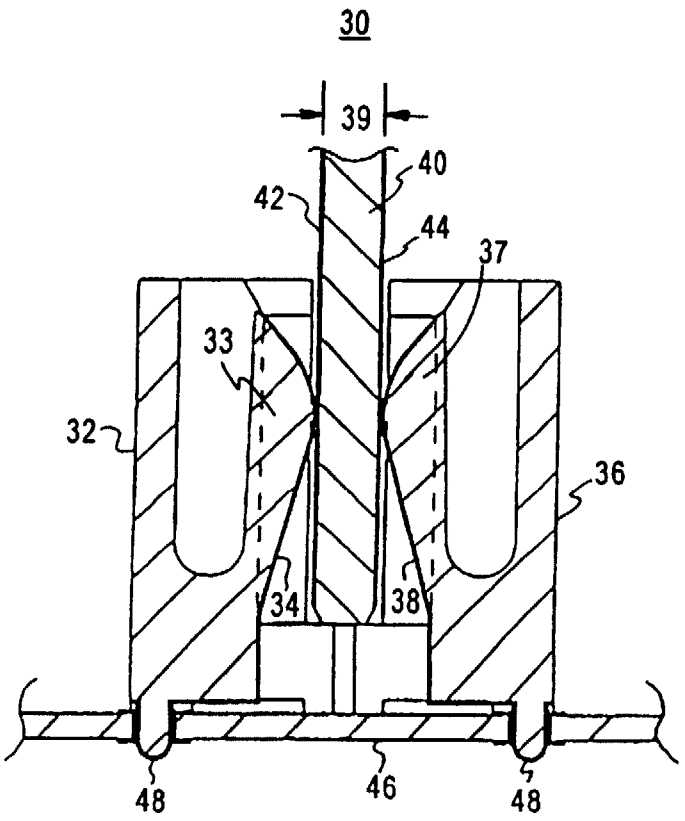

Referring to FIGS. 2*a* and 2*b*, side views are shown of an all-plastic zero insertion force electrical connector mounted on flex circuitry, according to a second embodiment of the present invention. The all-plastic ZIF electrical connector 30 provides an alternate arrangement for inserting PCB 40, such as a daughter card, into all-plastic ZIF electrical connector 30 without forcing PCB 40 between the contact-making fingers 33 and 37 of all-plastic ZIF electrical connector 30. Contact finger 33 is part of the first half 32 of connector 30 and contact finger 37 is part of the second half 36 of connector 30; as part of electrical connector 30, contact fingers 33 and 37 are made of all-plastic. Conductive trace 34 of contact finger 33 and conductive trace 38 of contact finger 37 are conductive traces that have been screened or plated onto the contact fingers 33 and 37.

All-plastic ZIF electrical connector 30 is intended to be used on flexible means 46, such as a flexible printed circuit, which may be flexed slightly to increase the opening 39 between the contact fingers 33 and 37 to accommodate insertion of the PCB 40. It should be noted that flexible means 46 may be flexed in such a manner so as to physically move only one contact finger 33 or 37. After PCB 40 has been located into the space between the electrical contact fingers 33 and 37, flex circuitry 46 is no longer flexed thereby allowing contact fingers 33 and 37 of housing 30 to return to their unflexed positions in which they make physical contact with PCB 40 and the size of opening 39 to return to original dimension. With PCB 40 thus positioned in housing 30, conductive traces 34 and 38 of contact fingers 33 and 37, respectively, make electrical contact with contact traces 42 and 44, respectively, of PCB 40. As an option, one or more clips (not shown) or other fastening means may then be attached to the ends of the all-plastic ZIF electrical connector 30 to force conductive traces 34 and 36 against the mating electrical contact traces 42 and 44 of the PCB 40 in order to ensure a good electrical connection. When it is desired to remove PCB 40 from housing 30, the flexible means 46 may be flexed thereby increasing the opening 39 between contact fingers 33 and 37 so that PCB 40 may be extracted without damaging the electrical contact traces 42 and 44 on PCB 40 during the extraction process.

The arrangement shown in FIGS. 2*a* and 2*b* offers the ability to insert and remove the PCB 40 with low or no insertion force, thus avoiding damage to electrical contact traces 42 and 44 on the PCB 40 while still being able to effect a tight mechanical and electrical contact between the contacts of the connector 30 and the connections on the PCB 40. Additionally, flexible circuit means 46 provides for the opening 39 between contact fingers 33 and 37 to be increased by simple finger action, without the need for tools to extricate PCB 40. In utilizing flexible means 46 to increase opening 39, only one of contact fingers 33 or 37 need be moved to achieve the desired opening dimension. Fingers 48 as shown in FIGS. 2*a* and 2*b* hold connector 30 to PCB 40. Fingers 48 may hold connector 30 to PCB 40, for example, by force fit or by soldering to mating holes in PCB 40.

The present invention described above in conjunction with FIGS. 2*a* and 2*b* provide these important advantages over the prior art. U.S. Pat. No. 3,614,707 issued to Kaufmann et al. on Oct. 19, 1971, for instance, does not use flexible means to easily and readily insert and remove a PCB from an electrical connector. Rather, the '707 patent requires the use of at least one contact pressure means and one spring member to secure a PCB in place. When it is desired to remove the PCB, the spring member must first be physically removed to discontinue contact pressure prior to removing the PCB from the receptacle of the electrical connector. Additionally, both upon inserting and removing a PCB from the receptacle of the electrical connector, both halves of the housing must be moved apart from one another to increase the size of the conductive receptacle to a dimension sufficient to accommodate insertion or removal of the PCB. This is in contrast to the present invention which requires that flexible means be flexed to move only one contact finger to increase opening 39 and does not require the removal of any portion of the allplastic housing in order to extricate PCB 40. Further, unlike U.S. Pat. No. 4,904,197 which disclosed the use of a cam in conjunction with a spring, cam 16 of the present invention need not be used in conjunction with other means to secure the PCB 18 inside ZIF electrical connector 10. The present invention is likewise distinguished over U.S. Pat. No. 4,626,056 which discloses cams which operate in conjunction with cam followers to control simultaneous movement of two halves of the connector housing.

Additionally, the second embodiment of the present invention only requires that one half of the housing of the ZIF electrical connector need move, under control of the flexible means, in order to secure a PCB in the ZIF electrical connector. This advantage is not to be found in the prior art where both halves of the electrical connector must simultaneously move to secure the PCB in the electrical connector.

In U.S. Pat. No. 4,904,197, a cam in conjunction with a spring controls simultaneous movement of a first and a second frame portion of the housing of the ZIF electrical connector away from or towards each other in order to effectuate insertion and removal of a card from the ZIF electrical connector. U.S. Pat. Nos. 4,629,270 and 4,626,056 likewise disclose that two halves of the housing of the electrical connector simultaneously move together or apart when removing or inserting a card in the electrical connector. The requirement that multiple parts of the ZIF electrical connector, as opposed to one part of the electrical connector, must simultaneously move in order to accommodate insertion and removal of a card increases the likelihood that the connector will not operate as required.

It is also important to note that the second embodiment of the present invention does not require special tools in order to activate the flexible means represented by flexible circuit 46. Simple finger action is all that is required to activate flexible circuit 46.

While the invention has been particularly shown and described with reference to a preferred embodiment, it will be understood by those skilled in the art that various changes in form and detail may be made therein without departing from the spirit and scope of the invention.

What is claimed is:

1. A zero insertion force electrical connector, comprising:

a body having a rigid section and a flexible section, said flexible section including:

a contact finger portion and a fixed portion defining a cavity therebetween, said rigid section having a first conductive trace located on a first edge thereof, and said flexible section having a second conductive trace located on a second edge thereof, said first conductive trace and said second conductive trace defining an opening therebetween; and a bias means rotatable connected to said fixed portion and partially positioned in said cavity;

said contact finger portion being movable by said bias means between a normal open position in which said connector can receive at least a portion of a printed circuit board and a biased closed position such that said first conductive trace and said second conductive trace are brought into electrical contact with the printed circuit board when said contact finger portion is moved into said biased closed position.

2. The connector of claim 1, wherein the bias means is a cam that is rotated about the longitudinal axis of the connector by finger pressure.

3. The connector of claim 1, wherein the rigid section and the flexible section are comprised of plastic.

4. The connector of claim 1, wherein when the bias means is activated the fixed portion of the second half of the zero insertion force connector remains fixed.

5. A method for establishing electrical contact between a zero insertion force connector and a printed circuit board, comprising the steps of:

inserting at least a portion of the printed circuit board into an opening formed between a rigid section and a flexible section of the zero insertion force connector, wherein the rigid section and the flexible section each have a contact trace and wherein the flexible section includes a contact finger portion, a fixed portion, and a cavity therebetween;

pivoting a bias means connected to the flexible section of the zero insertion force connector and partially positioned in the cavity; and flexing the contact finger portion from a normal open position in which the connector can receive at least a portion of the printed circuit board to a biased closed position such that the contact trace on the rigid section and the contact trace on the flexible section are brought into electrical contact with the printed circuit board when the contact finger portion is moved into the biased closed position.

6. The method of claim 5, wherein the flexing step is accomplished by a cam that is rotated about a longitudinal axis.

7. A zero insertion force electrical connector, comprising:

a first half having a first contact finger portion, a first fixed portion, and a first cavity between the first contact finger portion and the first fixed portion of the first half;

a second half having a second contact finger portion, a second fixed portion, and a second cavity between the second contact finger portion and the second fixed portion of the second half, wherein there is an opening between the first contact finger portion of the first half and the second contact finger portion of the second half for accepting a printed circuit board therebetween; and a first conductive trace located on a first edge of the first contact finger portion of the first half and a second conductive trace located on a second edge of the second contact finger portion of the second half of the zero insertion force electrical connector, wherein the distance between the first edge of the first half on which the first conductive trace is located and the second edge of the second half on which the second conductive trace is located defines the opening between the first half and the second half of the zero insertion force electrical connector;

a flexible medium on which the first half and the second half are mounted which provides for the first contact finger portion of the first half to moved to a flexed position by pulling the first contact finger portion away from the second contact finger portion of the first half thereby increasing the opening between the first half and the second half of the zero insertion force connector to accommodate insertion of the printed circuit board into the opening without touching a first contact trace on a first side of the printed circuit board to the first conductive trace or a second contact trace on the second side of the printed circuit board to the second conductive trace;

wherein after the printed circuit board is inserted between the first contact finger portion and the second contact finger portion, the first contact finger portion is released and the flexible medium provides for the first contact finger portion to return to an unflexed position in which a first electrical connection between the first conductive trace and the first contact trace and a second electrical connection between the second conductive trace and the second contact trace is obtained and the opening between the first half and the second half is returned to a pre-flexed position.

8. The connector of claim 7, wherein the flexible medium is a flexible printed circuit.

9. The connector of claim 7, wherein after the printed circuit board is inserted between the first contact finger portion and the second contact finger portion and the first contact finger portion is released, a fastening means may be attached to the first half and the second half of the zero insertion force connector to maintain the first electrical connection between the first conductive trace and the first contact trace and the second electrical connection between the second conductive trace and the second contact trace.

10. The connector of claim 7, wherein the printed circuit board is a daughter card.

11. The connector of claim 7, wherein the first half and the second half of the zero insertion force electrical connector are comprised of plastic.

12. A method for inserting a printed circuit board into a zero insertion force electrical connector and establishing electrical contact between the zero insertion force electrical connector and the printed circuit board, comprising the steps of:

flexing a first contact finger portion of a first half of the zero insertion force electrical connector from an unflexed position to a flexed position to increase an opening between the first contact finger portion of the first half and a second contact finger portion of a second half of the zero insertion force electrical connector in order to accommodate insertion of the printed circuit board in the opening, wherein the first half and a second half of the zero insertion force electrical connector are mounted to a flexible medium;

inserting the printed circuit board in the opening between the first contact finger portion and the second contact finger portion;

allowing the first contact finger portion of the first half of the zero insertion force electrical connector to return to the unflexed position so that a first contact trace on a first side of the printed circuit board is electrically connected to a first conductive trace of a first edge of the first contact finger portion and a second contact trace on a second side of the printed circuit board is electrically connected to a second conductive trace of a second edge of the second contact finger portion.

13. The method of claim 12, wherein after the step of allowing the first contact finger portion of the first half of the zero insertion force electrical connector to return to an unflexed position, comprising the further step of:

attaching a fastening means to the first half and the second half of the all-plastic zero insertion force connector to maintain the electrical connection of the first contact trace to the first conductive trace and to maintain the electrical connection of the second contact trace to the second conductive trace.

* * * * *